US005212861A

United States Patent [19]

Bevills

[11] Patent Number: 5,212,861

[45] Date of Patent: May 25, 1993

[54] OIL PUMP INSTALLATION AND REMOVAL TOOL

[75] Inventor: Raymond D. Bevills, Centerville, La.

[73] Assignee: Exxon Production Research Company, Houston, Tex.

[21] Appl. No.: 690,465

[22] Filed: Apr. 24, 1991

[51] Int. Cl.[5] ..... B25B 27/14

[52] U.S. Cl. ..... 29/281.1; 248/219.4; 248/354.3

[58] Field of Search ..... 29/281.1; 248/219.4, 248/242, 291, 354.3; 269/58

[56] References Cited

U.S. PATENT DOCUMENTS 1,102,480 7/1914 Davis ..... 248/242
1,662,152 3/1928 Logg ..... 248/354.3
2,436,799 3/1948 Frost ..... 248/354.3
2,725,210 11/1955 Swartz ..... 248/354.3
3,227,414 1/1966 Dean ..... 248/291
3,285,426 11/1966 Wilcke ..... 248/242

*Primary Examiner*—J. J. Swann
*Attorney, Agent, or Firm*—John R. Casperson

[57] ABSTRACT

An apparatus and method for moving heavy machinery in a confined space, particularly suited for installing or removing engine oil pumps from production equipment. The apparatus is formed from a bracket to be attached to the equipment to be moved; this bracket is pivotally attached to a first arm, which controls pivoting of the bracket face and pivotally attached to a second arm, which furnishes support. The arms are connected to each other such that the first arm and the second arm may pivot in parallel planes. The apparatus includes a frame for attaching the second arm to a support. Where the frame has the shape of an upside down "L" the support may overlie the workpiece.

5 Claims, 1 Drawing Sheet

OIL PUMP INSTALLATION AND REMOVAL TOOL

BACKGROUND OF THE INVENTION

The invention relates to an apparatus and method for moving heavy machinery within a confined space; in particular, the invention involves an apparatus and method for installing or removing an engine oil pump from oilfield production equipment.

The installation or removal of an engine oil pump for oilfield production equipment has presented high costs and great risk of injury each time these operations were undertaken: The pumps weigh approximately 400 kg (900 lbs) and are housed in locations with limited clearance on all sides. There is typically only 5 cm (2 inches) clearance between the pump and obstructions overhead and on the sides, and additional obstructions may be located below the pump. This setting negates the use of traditional tools, such as an overhead crane or a floor jack. In addition, because a yoke on the pump is wider than the hole in the engine block into which the pump must be maneuvered, the pump must be tilted or pivoted to install or remove it from the engine. This presents a difficult task, and one which is currently accomplished entirely by manual labor, usually requiring the efforts of four people over the span of about 14 hours. The task requires placement of hands and arms between the pump and obstructions, thereby presenting a risk of injury. Likewise, the economic cost is high. During this operation, and entire oilfield is shut down, costing valuable production. Also the additional labor costs for the required personnel must be considered.

SUMMARY OF THE INVENTION

The invention provides apparatus and method to allow the pump to be maneuvered into place using a hoist or support despite confined nature of the workspace. The configuration of the invention is such that it has the required pivotability of a jack, and the weightbearing ability of a conventional crane, yet it conforms to the space available. Using the invention, installation or removal of a pump requires only one person, and may be accomplished in about an hour. Cost savings from decreased downtime and sharply reduced labor are realized. In addition, because the pump is maneuvered at all times while being supported by a hoist, the risk of injury is greatly reduced. The advantages of this invention will be readily apparent to those skilled in the art.

DESCRIPTION OF THE PREFERRED EMBODIMENT

Figure 1:
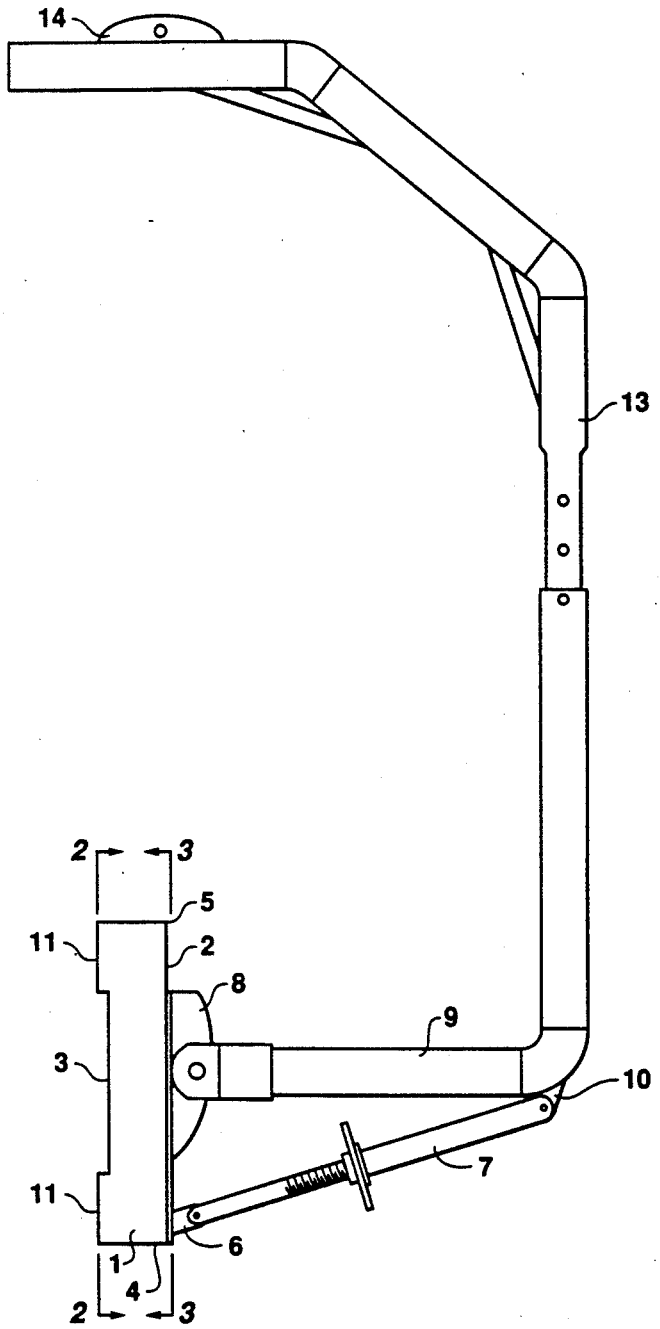
FIG. 1 illustrates pictorially the assembled apparatus.

Referring to FIG. 1, an embodiment of the invention is constructed comprising three elements and means for attaching the elements to a support cable of bearing the weight to be moved. A bracket, indicated at 1 in FIG. 1, having a first face, indicated at 2 in FIG. 1, and a second face, indicated at 3 in FIG. 1, and having a first edge, indicated at 4 in FIG. 1, and a second edge, indicated at 5 in FIG. 1 is constructed. A first means, indicated at 6 in FIG. 1, is positioned near the first edge of the bracket for pivotally connecting a first arm, indicated at 7 in FIG. 1, and a second means, indicated at 8 in FIG. 1, is positioned between the first means and the second edge for pivotally connecting a second arm, indicated at 9 in FIG. 1. The first arm, indicated at 7 in FIG. 1, is pivotally connected to the first face of the bracket at the first means, and the second arm, indicated at 9 in FIG. 1, is pivotally connected to the first face of the bracket at the second means. The first arm and the second arm are likewise pivotally connected to each other, as shown at 10 in FIG. 1, such that the first arm and the second arm may pivot in parallel planes preferably in substantially the same plane and such that the first arm and the second arm extend outward away from the bracket. The apparatus should include frame means for attaching the second arm to a support.

Figure 2:
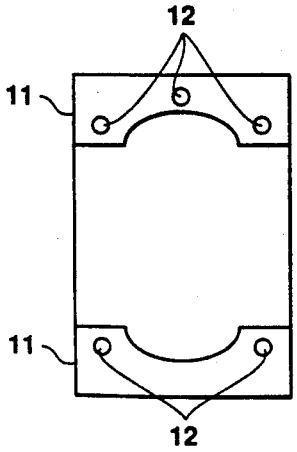
FIG. 2 illustrates a preferred embodiment of a portion of the apparatus shown in FIG. 1 when received along line 2—2.

In a preferred embodiment of the invention, the bracket may be constructed as is shown in FIG. 1 and FIG. 2. In this embodiment the bracket is constructed as a flanged plate, such that a rim, indicated at 11 in FIGS. 1 and 2, protrudes from the second face of the bracket and may cradle the pump or object to be moved, assisting in its support.

Figure 3:
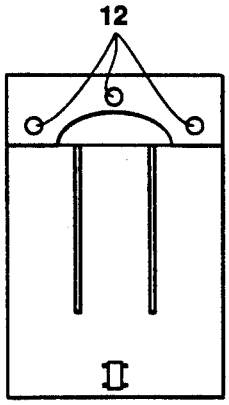
FIG. 3 illustrates the portion of the apparatus shown in FIG. 2 when viewed along line 3—3 of FIG. 1.

In another preferred embodiment of the invention shown in FIG. 2 and FIG. 3, a plurality of bolt holes, indicated 12 in FIGS. 2 and 3, are made in the bracket. These holes should align with a matching bolt pattern on the pump case or object to be moved. Bolts may then be removed from the pump case and used to attach the pump to the bracket.

In another preferred embodiment of the invention, the means for attaching the second arm to a support comprises a frame, indicated at 13 in FIG. 1, attached to the second arm, and extending vertically upward from the second arm, and, at some distance from the second arm, bending such that frame has a portion of its length which doubles back with respect to the second arm and may, and preferably does, overlie the second arm, the frame thereby assuming the shape of an upside-down "J" or L. Means for attaching the frame to a support, such as eyelets indicated at 14 in FIG. 1, are located on a portion of the frame which may overlie the second arm.

In a preferred embodiment of the invention, the frame just described may be constructed of tubing made from a material such as steel.

In a most preferred embodiment of the invention, the vertical section of the frame, indicated at 13 in FIG. 1, will be a telescoping assembly having at least one section of tubing, whereby the overall height of the frame may be adjusted to fit the dimensions of the particular workplace.

In yet another embodiment of the invention, the bracket shown in FIG. 1 is pivotally connected to an adjustable first arm, indicated at 7 in FIG. 1, and to a second arm, indicated at 9 in FIG. 1. The first arm and the second arm are also pivotally connected to each other. The second arm is attached to a support capable of bearing the weight of the oil pump to be installed. The first face of the bracket, indicated at 3 in FIG. 1, is then attached to the oil pump. The pump is lifted, using the support and the bracket-arm assembly, and is placed in the appropriate housing, adjusting the first rm, indicated at 7 in FIG. 1, to control the swivel and thereby maneuver the pump into the housing. Once the pump is in the housing, the bracket is detached from the pump.

In a preferred embodiment of the invention, the bracket to be attached to the oil pump is a flanged plate, as shown in FIG. 1 and FIG. 2, such that a rim, indicated at 11 in FIGS. 1 and 2 protrudes from the second face of the bracket, indicated at 3 in FIG. 1 and shown frontally in FIG. 2, and may cradle a portion of the oil pump to be removed.

In another preferred embodiment of the invention, a plurality of holes, indicated at 12 in FIGS. 2 and 3, have been made in the bracket, such that the plurality of holes will align with bolt holes in the casing of the oil pump to be installed. Holes on the pump casing are then aligned with those on the bracket, bolts are inserted through the bracket and through the pump, attaching the pump to the bracket. The pump is then installed as before, adjusting the first arm, indicated at 7 in FIG. 1, to pivot the pump.

The adjustable first arm is preferably formed by a screw jack having a pivotal connection at each end.

We claim:

1. An apparatus comprising:

a) a bracket having a first face and an oppositely facing second face, a first edge and a second edge, a first means positioned on the first face near the first edge of the bracket for pivotally connecting a first arm, and a second means positioned on the first face between the first means and the second edge for pivotally connecting a second arm;

b) a first arm, being of adjustable length, connected to the first face of the bracket at the first means;

c) a second arm, connected to the first face of the bracket at the second means, wherein both the first arm and the second arm are pivotally connected to the bracket and are pivotally connected to each other, such that said first arm and second arm are pivotable with respect to the second face of the bracket in substantially the same plane, and such that the first arm and the second arm extend outwardly away from the bracket; and d) a frame having a first portion extending vertically upward from the second arm, and, at a spaced apart distance from the second arm, a second portion which bends away from the first portion such that the frame has a portion of its length which doubles back with respect to the second arm to overlie the second arm, wherein the frame has the shape of an upside-down "L" and wherein means for attaching the frame to a support are located on the second portion of the frame overlying the second arm.

2. An apparatus as in claim 1, wherein the bracket is a flanged plate, such that a rim protrudes from the second face of the bracket for engaging a portion of an object to be moved.

3. An apparatus as in claim 1, wherein a plurality of holes have been made in the bracket suitable for housing a plurality of bolts, such that the plurality of bolts may be used to attach the bracket to an object to be moved.

4. An apparatus as in claim 1, wherein the frame is constructed of tubing.

5. An apparatus as in claim 1, wherein the first portion of the frame is a telescoping assembly, so that the overall height of the frame may be adjusted.

* * * * *